US010559882B2

(12) United States Patent
Lee et al.

(10) Patent No.: US 10,559,882 B2
(45) Date of Patent: Feb. 11, 2020

(54) MOBILE DEVICE

(71) Applicant: Quanta Computer Inc., Taoyuan (TW)

(72) Inventors: Kuan-Hsien Lee, Taoyuan (TW); Chung-Ting Hung, Taoyuan (TW); Chin-Lung Tsai, Taoyuan (TW); Ching-Hai Chiang, Taoyuan (TW); Chung-Hung Lo, Taoyuan (TW); Ying-Cong Deng, Taoyuan (TW); Yi-Ling Tseng, Taoyuan (TW)

(73) Assignee: QUANTA COMPUTER INC., Guishan Dist., Taoyuan (TW)

( * ) Notice: Subject to any disclaimer, the term of this patent is extended or adjusted under 35 U.S.C. 154(b) by 0 days.

(21) Appl. No.: 15/987,149

(22) Filed: May 23, 2018

(65) Prior Publication Data

US 2019/0131693 A1 May 2, 2019

(30) Foreign Application Priority Data

Oct. 27, 2017 (TW) ..... 106137083 A

(51) Int. Cl.
*H01Q 5/378* (2015.01)
*H01Q 5/371* (2015.01)
*H01Q 9/42* (2006.01)

(52) U.S. Cl.
CPC ..... *H01Q 5/378* (2015.01); *H01Q 5/371* (2015.01); *H01Q 9/42* (2013.01)

(58) Field of Classification Search
CPC ..... H01Q 5/371; H01Q 5/378; H01Q 5/392; H01Q 9/42
See application file for complete search history.

(56) References Cited

U.S. PATENT DOCUMENTS

2012/0242555 A1* 9/2012 Hsieh ..... H01Q 1/243 343/833

FOREIGN PATENT DOCUMENTS

TW 201240212 A 10/2012

OTHER PUBLICATIONS

Chinese language office action dated Jul. 12, 2018, issued in application No. TW 106137083.

* cited by examiner

*Primary Examiner* — Robert Karacsony
(74) *Attorney, Agent, or Firm* — McClure, Qualey & Rodack, LLP

(57) ABSTRACT

A mobile device includes a nonconductive mechanism element and an antenna structure. The antenna structure is formed over the nonconductive mechanism element. The antenna structure includes a feeding connection element, a first radiation element, a second radiation element, a grounding connection element, and a third radiation element. The feeding connection element is coupled to a feeding point. A first end of the first radiation element is coupled to the feeding connection element, and a second end of the first radiation element is open. A first end of the second radiation element is coupled to the feeding connection element, and a second end of the second radiation element is open. The grounding connection element is coupled to a grounding point. A first end of the third radiation element is coupled to the grounding connection element, and a second end of the third radiation element is open.

7 Claims, 5 Drawing Sheets

MOBILE DEVICE

CROSS REFERENCE TO RELATED APPLICATIONS

This Application claims priority of Taiwan Patent Application No. 106137083 filed on Oct. 27, 2017, the entirety of which is incorporated by reference herein.

BACKGROUND OF THE INVENTION

Field of the Invention

The disclosure generally relates to a mobile device, and specifically, to a mobile device and an antenna structure therein.

Description of the Related Art

With the progress being made in mobile communication technology, mobile devices such as portable computers, mobile phones, tablet computers, multimedia players, and other hybrid functional mobile devices have become common. To satisfy the demands from users, mobile devices can usually perform wireless communication functions. Some functions cover a large wireless communication area; for example, mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some functions cover a small wireless communication area; for example, mobile phones using Wi-Fi and Bluetooth systems and using frequency bands of 2.4 GHz, 5.2 GHz, and 5.8 GHz.

Antennas are indispensable elements in mobile devices supporting wireless communications. However, since the inner space of a mobile device is limited, there is not sufficient area for accommodating the desired antennas, and this results in a narrow antenna bandwidth and poor communication quality of the mobile device. Accordingly, it has become a critical challenge for current designers to design a novel small-size, wideband antenna.

BRIEF SUMMARY OF THE INVENTION

In a preferred embodiment, the disclosure is directed to a mobile device including a nonconductive mechanism element and an antenna structure. The antenna structure is formed over the nonconductive mechanism element. The antenna structure includes a feeding connection element, a first radiation element, a second radiation element, a grounding connection element, and a third radiation element. The feeding connection element is coupled to a feeding point. The first radiation element has a first end and a second end. The first end of the first radiation element is coupled to the feeding connection element, and the second end of the first radiation element is open. The second radiation element has a first end and a second end. The first end of the second radiation element is coupled to the feeding connection element, and the second end of the second radiation element is open. The grounding connection element is coupled to a grounding point. The third radiation element has a first end and a second end. The first end of the third radiation element is coupled to the grounding connection element, and the second end of the third radiation element is open.

In some embodiments, the second end of the third radiation element is substantially surrounded by the first radiation element, such that a first coupling gap and a second coupling gap are formed between the first radiation element and the second end of the third radiation element.

In some embodiments, the nonconductive mechanism element substantially has a cuboid shape. The cuboid shape has a first surface, a second surface, a third surface, and a fourth surface. The second surface and the fourth surface are adjacent and perpendicular to the first surface. The third surface is opposite and parallel to the first surface.

In some embodiments, the first radiation element substantially has a U-shape. The first radiation element extends from the first surface through the second surface onto the third surface of the nonconductive mechanism element.

In some embodiments, the second radiation element substantially has a straight-line shape. The second radiation element is disposed on the first surface of the nonconductive mechanism element.

In some embodiments, the third radiation element substantially has a straight-line shape. The third radiation element is disposed on the second surface of the nonconductive mechanism element.

In some embodiments, the antenna structure further includes a fourth radiation element. The fourth radiation element has a first end and a second end. The first end of the fourth radiation element is coupled to the grounding connection element, and the second end of the fourth radiation element is open.

In some embodiments, the fourth radiation element substantially has an L-shape. The fourth radiation element extends from the second surface onto the third surface of the nonconductive mechanism element.

In some embodiments, the antenna structure covers a first frequency band from 700 MHz to 960 MHz, a second frequency band from 1450 MHz to 2700 MHz, and a third frequency band from 5150 MHz to 5850 MHz.

In some embodiments, the feeding connection element, the first radiation element, the grounding connection element, and the third radiation element are excited to generate the first frequency band. The feeding connection element, the second radiation element, the grounding connection element, and the fourth radiation element are excited to generate the second frequency band. The third radiation element is excited by the first radiation element using a coupling mechanism to generate the third frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are described in detail below.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
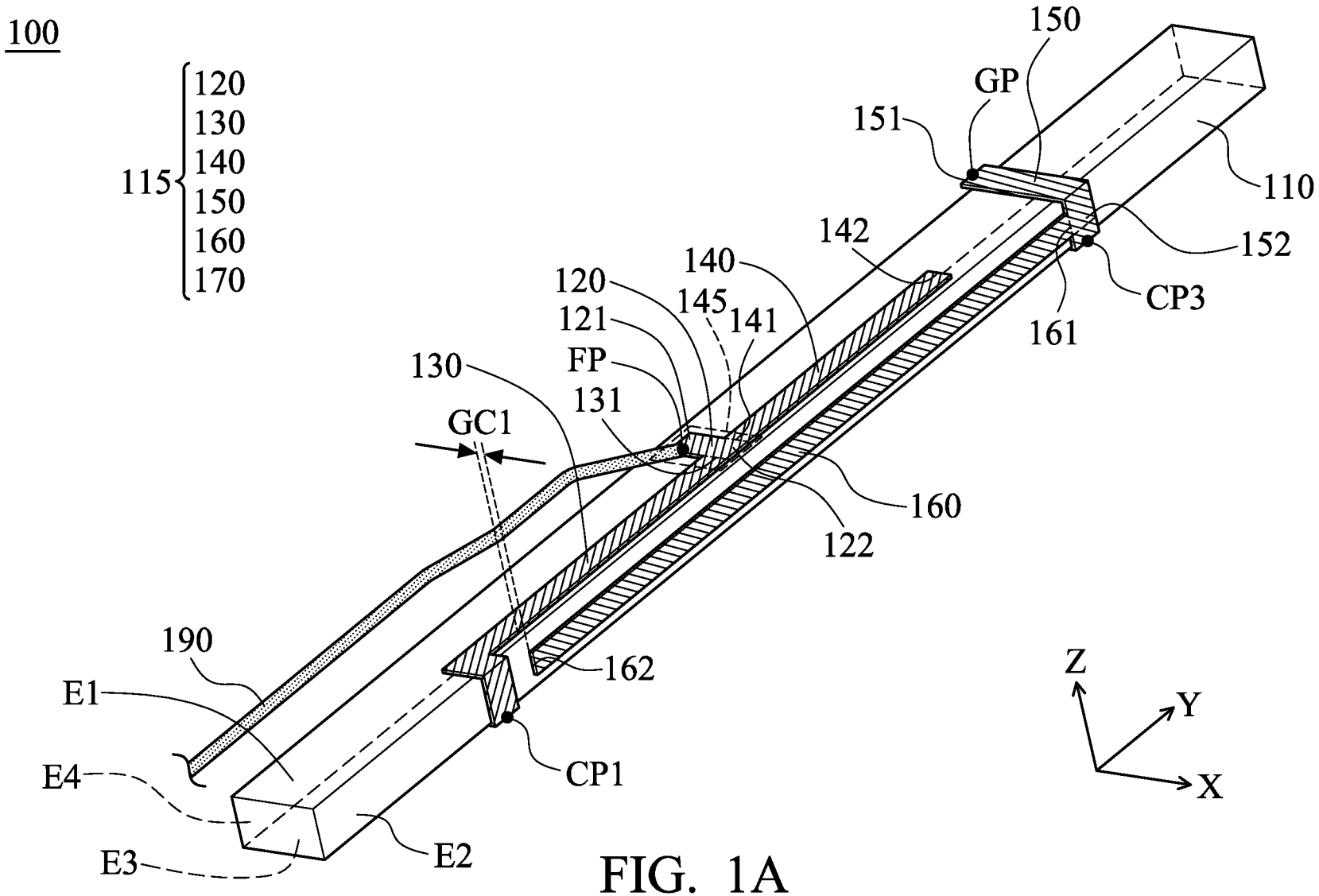
FIG. 1A is a perspective view of a mobile device according to an embodiment of the invention.
Figure 1B:
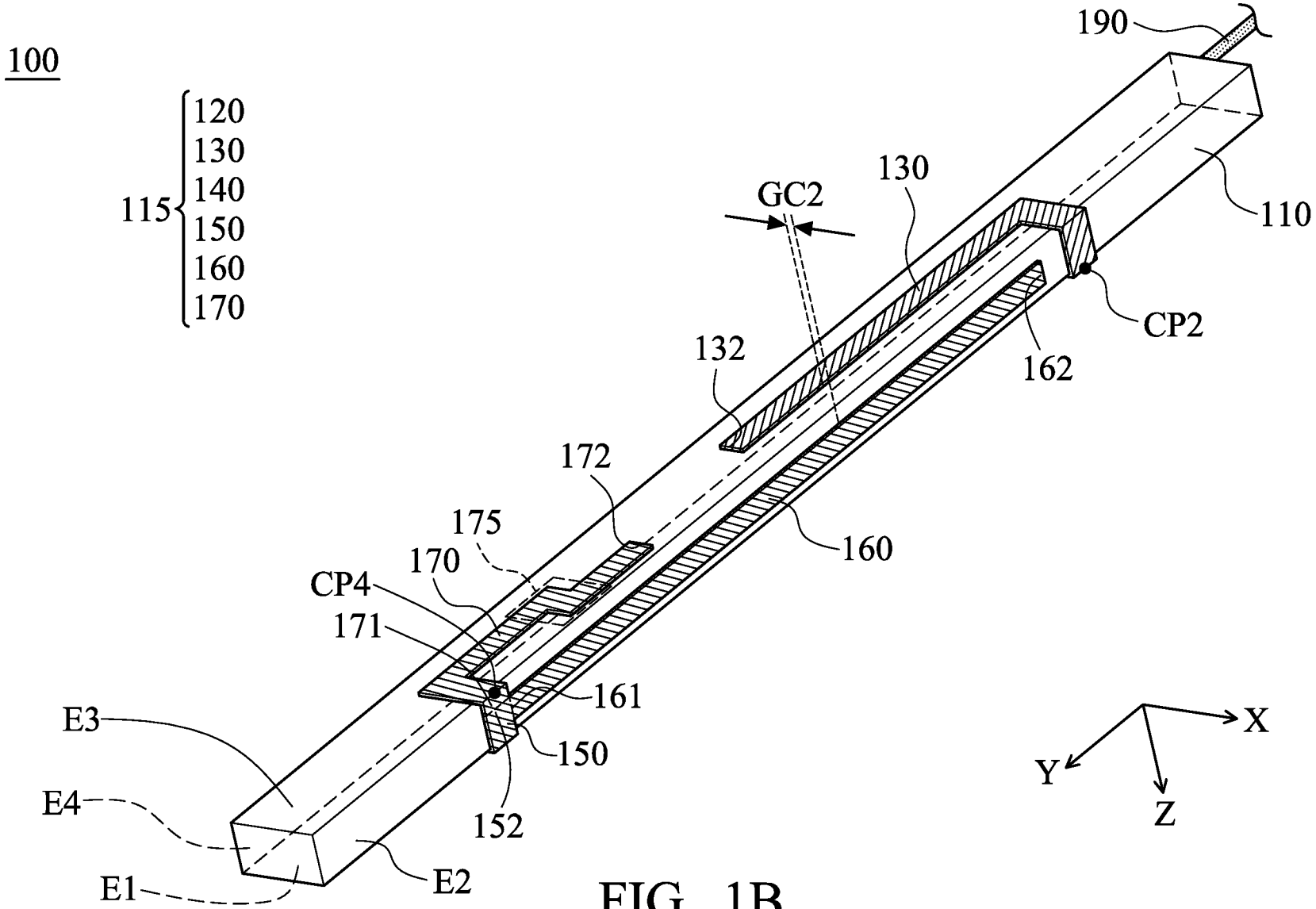
FIG. 1B is a perspective view of a mobile device according to another embodiment of the invention.

FIG. 1A is a perspective view of a mobile device 100 according to an embodiment of the invention. FIG. 1B is a perspective view of the mobile device 100 according to another embodiment of the invention. Please refer to FIG. 1A and FIG. 1B together, which are used to describe different views of the same mobile device 100. The mobile device 100 may be a smartphone, a tablet computer, or a notebook computer. As shown in FIG. 1A and FIG. 1B, the mobile device 100 at least includes a nonconductive mechanism element 110 and an antenna structure 115. The nonconductive mechanism element 110 may be a plastic carrier element for supporting or carrying the antenna structure 115. The antenna structure 115 may be a 3D (Three-Dimensional) structure made of a metal material. For example, the antenna structure 115 may be formed over the nonconductive mechanism element 110 using a printing process or an LDS (Laser Direct Structuring) process. It should be understood that the mobile device 100 may further include other components, such as a display device, a speaker, a touch control module, a battery, and a housing, although they are not displayed in FIG. 1A and FIG. 1B.

The shape and type of the nonconductive mechanism element 110 are not limited in the invention. In some embodiments, the nonconductive mechanism element 110 substantially has a cuboid shape. Specifically, the aforementioned cuboid shape has a first surface E1, a second surface E2, a third surface E3, and a fourth surface E4. The second surface E2 and the fourth surface E4 are adjacent to the first surface E1 and are substantially perpendicular to the first surface E1. The third surface E3 is opposite to the first surface E1 and is substantially parallel to the first surface E1. In other words, the first surface E1, the second surface E2, the third surface E3, and the fourth surface E4 may be connected to each other, and their combination may be substantially a hollow rectangular prism. In alternative embodiments, adjustments are made such that the nonconductive mechanism element 110 is substantially a cylinder or a triangular prism.

The antenna structure 115 at least includes a feeding connection element 120, a first radiation element 130, a second radiation element 140, a grounding connection element 150, and a third radiation element 160, and their structures and arrangements may be as follows.

The feeding connection element 120 may substantially have a rectangular shape (a planar rectangular shape). The feeding connection element 120 may be disposed on the first surface E1 of the nonconductive mechanism element 110. Specifically, the feeding connection element 120 has a first end 121 and a second end 122. The first end 121 of the feeding connection element 120 is coupled to a feeding point FP. The feeding point FP may be further coupled through a coaxial cable 190 to a signal source (not shown). For example, the aforementioned signal source may be an RF (Radio Frequency) module for exciting the antenna structure 115.

The first radiation element 130 may substantially have a U-shape (a 3D U-shape). The first radiation element 130 may extend from the first surface E1 through the second surface E2 onto the third surface E3 of the nonconductive mechanism element 110 (i.e., a second connection point CP2 of FIG. 1B is equivalent to a first connection point CP1 of FIG. 1A). Specifically, the first radiation element 130 has a first end 131 and a second end 132. The first end 131 of the first radiation element 130 is coupled to the second end 122 of feeding connection element 120. The second end 132 of the first radiation element 130 is open.

The second radiation element 140 may substantially have a straight-line shape (a planar straight-line shape). The second radiation element 140 may be disposed on the first surface E1 of the nonconductive mechanism element 110. Specifically, the second radiation element 140 has a first end 141 and a second end 142. The first end 141 of the second radiation element 140 is coupled to the second end 122 of the feeding connection element 120. The second end 142 of the second radiation element 140 is open. In some embodiments, a combination of the second radiation element 140, the first radiation element 130, and the feeding connection element 120 includes a T-shaped connection portion 145. The second end 142 of the second radiation element 140 and the second end 132 of the first radiation element 130 may substantially extend in the same direction (e.g., parallel to the direction of the +Y-axis of FIG. 1A and FIG. 1B). The length of the second radiation element 140 is shorter than the length of the first radiation element 130. For example, the length of the first radiation element 130 may be two to three times the length of the second radiation element 140.

The grounding connection element 150 may substantially have a straight-line shape (a 3D straight-line shape). The grounding connection element 150 may extend from the first surface E1 onto second surface E2 of the nonconductive mechanism element 110 (i.e., a fourth connection point CP4 of FIG. 1B is equivalent to a third connection point CP3 of FIG. 1A). Specifically, the grounding connection element 150 has a first end 151 and a second end 152. The first end 151 of the grounding connection element 150 is coupled to a grounding point GP. The grounding point GP may be further coupled to a ground plane region of the mobile device 100, and the ground plane region can provide a ground voltage.

The third radiation element 160 may substantially have a straight-line shape (a planar straight-line shape). The third radiation element 160 may be disposed on the second surface E2 of the nonconductive mechanism element 110. Specifically, third radiation element 160 has a first end 161 and a second end 162. The first end 161 of the third radiation element 160 is coupled to the second end 152 of the grounding connection element 150. The second end 162 of the third radiation element 160 is open. As mentioned above, if the first radiation element 130 substantially has a U-shape (a 3D U-shape) and defines a notch, the second end 162 of the third radiation element 160 may extend into the interior of the notch of the first radiation element 130. The second end 162 of the third radiation element 160 may be substantially surrounded by the first radiation element 130, such that a first coupling gap GC1 and a second coupling gap GC2 are formed between the first radiation element 130 and the second end 162 of the third radiation element 160. Accordingly, the mutual coupling effect is induced between the third radiation element 160 and the first radiation element 130, such that the third radiation element 160 is excited by the first radiation element 130 using a coupling mechanism.

In some embodiments, the antenna structure 115 further includes a fourth radiation element 170. The fourth radiation element 170 may substantially have an L-shape (a 3D L-shape). The fourth radiation element 170 may extend from the second surface E2 onto the third surface E3 of the nonconductive mechanism element 110. Specifically, the fourth radiation element 170 has a first end 171 and a second end 172. The first end 171 of the fourth radiation element 170 is coupled to the second end 152 of the grounding connection element 150. The second end 172 of the fourth radiation element 170 is open. In some embodiments, the fourth radiation element 170 further includes an N-shaped bending portion 175, which is positioned between the first end 171 and the second end 172 of the fourth radiation element 170, so as to fine-tune the impedance matching of the antenna structure 115. The second end 172 of the fourth radiation element 170 and the second end 132 of the first radiation element 130 may substantially extend in opposite directions to become closer to each other (e.g., parallel to the direction of the −Y-axis and the direction of the +Y-axis of FIG. 1A and FIG. 1B, respectively). The length of the fourth radiation element 170 is shorter than the length of the third radiation element 160. For example, the length of the third radiation element 160 may be two to three times the length of the fourth radiation element 170. The fourth radiation element 170 is an optional element for increasing the bandwidth of the antenna structure 115. In other embodiments, the fourth radiation element 170 is omitted.

Figure 2:
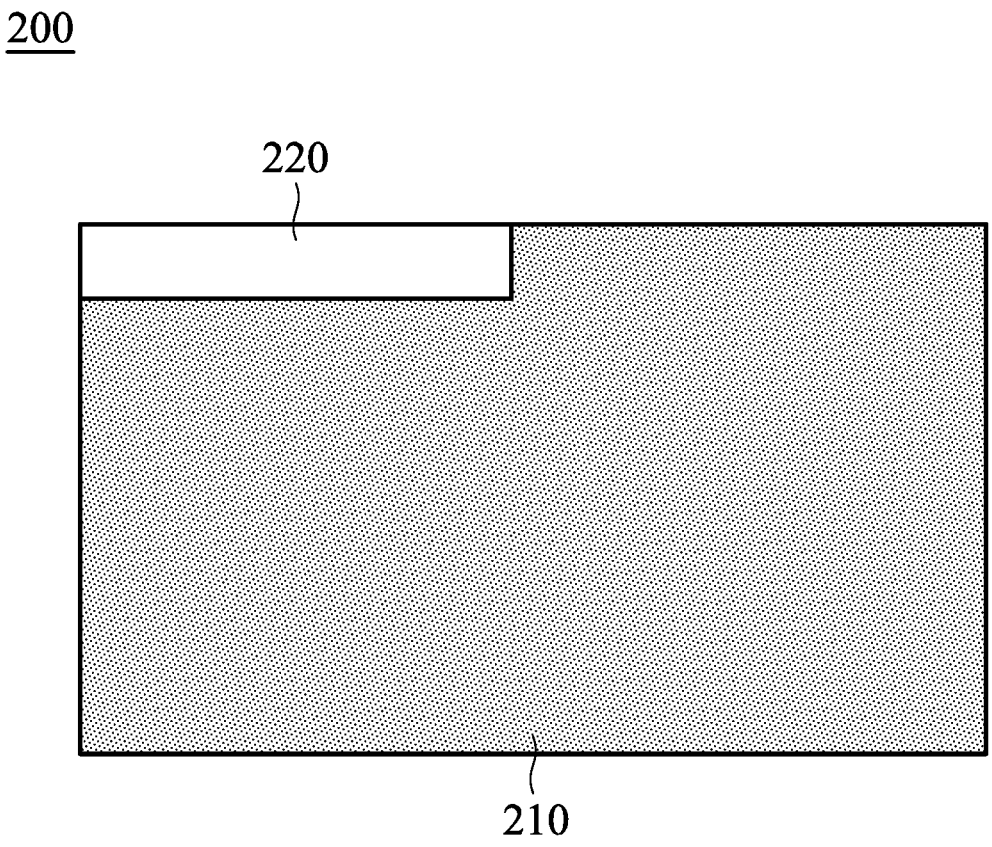
FIG. 2 is a diagram of a system circuit board of a mobile device according to an embodiment of the invention.

FIG. 2 is a diagram of a system circuit board 200 of the mobile device 100 according to an embodiment of the invention. In the embodiment of FIG. 2, the mobile device 100 further includes a system circuit board 200. The system circuit board 200 includes a ground plane region 210 and a clearance region 220. The ground plane region 210 can provide a ground voltage. For example, the aforementioned grounding point GP may be coupled to the ground plane region 210. The clearance region 220 may be a non-metal region. The clearance region 220 may substantially have a rectangular shape, and it may be positioned at any one of four corners of the system circuit board 200. In some embodiments, the nonconductive mechanism element 110 and the antenna structure 115 of FIG. 1A and FIG. 1B are disposed inside the clearance region 220, such that the antenna structure 115 does not tend to be negatively affected by other metal elements or circuit elements on the system circuit board 200.

Figure 3:
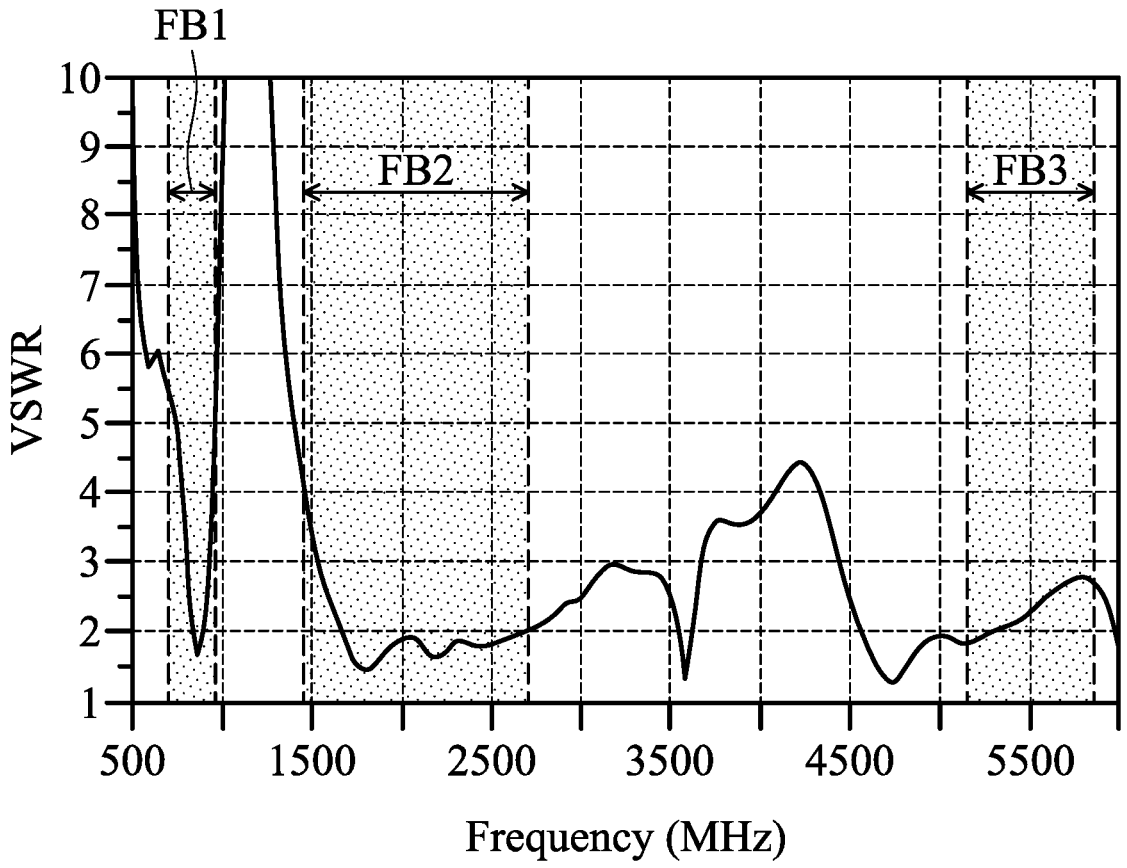
FIG. 3 is a diagram of VSWR (Voltage Standing Wave Ratio) of an antenna structure of a mobile device according to an embodiment of the invention.

FIG. 3 is a diagram of VSWR (Voltage Standing Wave Ratio) of the antenna structure 115 of the mobile device 100 according to an embodiment of the invention. The horizontal axis represents operation frequency (MHz), and the vertical axis represents the VSWR. According to the measurement of FIG. 3, the antenna structure 115 can cover a first frequency band FB1, a second frequency band FB2, and a third frequency band FB3. The first frequency band FB1 may be from 700 MHz to 960 MHz. The second frequency band FB2 may be from 1450 MHz to 2700 MHz. The third frequency band FB3 may be from 5150 MHz to 5850 MHz. Therefore, the antenna structure 115 of the mobile device 100 can support at least the wideband operations of LTE (Long Term Evolution) 3 GHz (Band 22/Band 42/Band 43/Band 48) and 5 GHz (LTE-U), and it is suitable for application in a variety of LTE communication devices over the world.

In some embodiments, the operation principles of the mobile device 100 and the antenna structure 115 are as follows. The feeding connection element 120, the first radiation element 130, the grounding connection element 150, and the third radiation element 160 are excited to generate the first frequency band FB1. The feeding connection element 120, the second radiation element 140, the grounding connection element 150, and the fourth radiation element 170 are excited to generate the second frequency band FB2. The third radiation element 160 is further excited by the first radiation element 130 using a coupling mechanism, so as to generate the third frequency band FB3. The fourth radiation element 170 mainly contributes to a low-frequency portion of the second frequency band FB2. If the fourth radiation element 170 were removed, the second frequency band FB2 would be adjusted to be from 1700 MHz to 2700 MHz (i.e., the resonant frequency interval from 1450 MHz to 1700 MHz would vanish).

In some embodiments, the element sizes of the mobile device 100 and the antenna structure 115 are as follows. The total length of the feeding connection element 120 and the first radiation element 130 (i.e., the total length from the first end 121 through the second end 122 and the first end 131 to the second end 132) may be substantially equal to 0.25 wavelength (λ/4) of the central frequency of the first frequency band FB1. The total length of the grounding connection element 150 and the third radiation element 160 (i.e., the total length from the first end 151 through the second end 152 and the first end 161 to the second end 162) may be substantially equal to 0.25 wavelength (λ/4) of the central frequency of the first frequency band FB1. The total length of the feeding connection element 120 and the second radiation element 140 (i.e., the total length from the first end 121 through the second end 122 and the first end 141 to the second end 142) may be substantially equal to 0.25 wavelength (λ/4) of the central frequency of the second frequency band FB2. The total length of the grounding connection element 150 and the fourth radiation element 170 (i.e., the total length from the first end 151 through the second end 152 and the first end 171 to the second end 172) may be substantially equal to 0.25 wavelength (λ/4) of the central frequency of the second frequency band FB2. In order to enhance the mutual coupling effect between the first radiation element 130 and the third radiation element 160, the width of the first coupling gap GC1 between a first half portion of the first radiation element 130 and the third radiation element 160 may be shorter than 1.5 mm (the first half portion of the first radiation element 130 is adjacent to the first end 131), and the width of the second coupling gap GC2 between a second half portion of the first radiation element 130 and the third radiation element 160 may be shorter than 2.5 mm (the second half portion of the first radiation element 130 is adjacent to the second end 132). The above ranges of element sizes are calculated and obtained according to many experimental results, and they help to optimize the operation frequency bands and the impedance matching of the antenna structure 115 of the mobile device 100.

Figure 4:
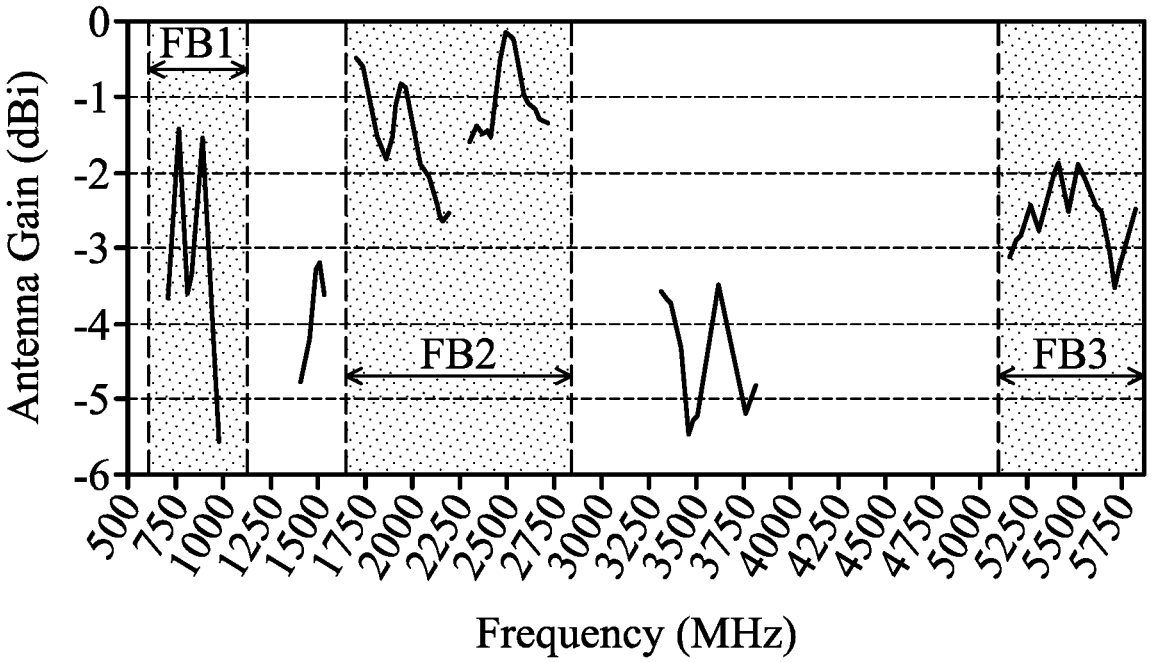
FIG. 4 is a diagram of antenna gain of an antenna structure of a mobile device according to an embodiment of the invention.

FIG. 4 is a diagram of antenna gain of the antenna structure 115 of the mobile device 100 according to an embodiment of the invention. The horizontal axis represents operation frequency (MHz), and the vertical axis represents the antenna gain (dBi). According to the measurement of FIG. 4, the antenna gain of the antenna structure 115 is almost higher than −3 dBi over the first frequency band FB1, the second frequency band FB2, and the third frequency band FB3, and it can meet the requirements of practical application of general mobile communication devices.

The invention proposes a novel mobile device and an antenna structure therein. In comparison to the conventional design, the invention has at least the following advantages: (1) the size of the antenna structure is not large, so that the antenna structure can be disposed inside the limited inner space of the mobile device; (2) the antenna structure is capable of covering wideband operations, and it can support all of the LTE communication frequency bands in the world; and (3) the antenna structure has a low design complexity, so as to reduce the whole manufacturing cost. In conclusion, the invention is suitable for application in a variety of small-size, wideband mobile communication devices.

Note that the above element sizes, element shapes, and frequency ranges are not limitations of the invention. An antenna designer can adjust these settings or values according to different requirements. It should be understood that the mobile device and the antenna structure of the invention are not limited to the configurations of FIGS. 1-4. The invention may merely include any one or more features of any one or more embodiments of FIGS. 1-4. In other words, not all of the features shown in the figures should be implemented in the mobile device and the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with the true scope of the disclosed embodiments being indicated by the following claims and their equivalents.

What is claimed is:

1. A mobile device, comprising:

a nonconductive mechanism element; and an antenna structure, formed over the nonconductive mechanism element, wherein the antenna structure comprises:

a feeding connection element, coupled to a feeding point;

a first radiation element, having a first end and a second end, wherein the first end of the first radiation element is coupled to the feeding connection element, and the second end of the first radiation element is open;

a second radiation element, having a first end and a second end, wherein the first end of the second radiation element is coupled to the feeding connection element, and the second end of the second radiation element is open;

a grounding connection element, coupled to a grounding point; and a third radiation element, having a first end and a second end, wherein the first end of the third radiation element is coupled to the grounding connection element, and the second end of the third radiation element is open;

wherein the second end of the third radiation element is substantially surrounded by the first radiation element, such that a first coupling gap and a second coupling gap are formed between the first radiation element and the second end of the third radiation element;

wherein the nonconductive mechanism element substantially has a cuboid shape, wherein the cuboid shape has a first surface, a second surface, a third surface, and a fourth surface, wherein the second surface and the fourth surface are adjacent and perpendicular to the first surface, and wherein the third surface is opposite and parallel to the first surface;

wherein the first radiation element substantially has a U-shape, and wherein the first radiation element extends from the first surface through the second surface onto the third surface of the nonconductive mechanism element.

2. The mobile device as claimed in claim 1, wherein the second radiation element substantially has a straight-line shape, and wherein the second radiation element is disposed on the first surface of the nonconductive mechanism element.

3. The mobile device as claimed in claim 1, wherein the third radiation element substantially has a straight-line shape, and wherein the third radiation element is disposed on the second surface of the nonconductive mechanism element.

4. The mobile device as claimed in claim 1, wherein the antenna structure further comprises:

a fourth radiation element, having a first end and a second end, wherein the first end of the fourth radiation element is coupled to the grounding connection element, and the second end of the fourth radiation element is open.

5. The mobile device as claimed in claim 4, wherein the fourth radiation element substantially has an L-shape, and wherein the fourth radiation element extends from the second surface onto the third surface of the nonconductive mechanism element.

6. The mobile device as claimed in claim 4, wherein the antenna structure covers a first frequency band from 700 MHz to 960 MHz, a second frequency band from 1450 MHz to 2700 MHz, and a third frequency band from 5150 MHz to 5850 MHz.

7. The mobile device as claimed in claim 6, wherein the feeding connection element, the first radiation element, the grounding connection element, and the third radiation element are excited to generate the first frequency band, wherein the feeding connection element, the second radiation element, the grounding connection element, and the fourth radiation element are excited to generate the second frequency band, and wherein the third radiation element is excited by the first radiation element using a coupling mechanism to generate the third frequency band.

* * * * *